US007028968B2

(12) United States Patent
Washick

(10) Patent No.: US 7,028,968 B2
(45) Date of Patent: Apr. 18, 2006

(54) ROTATING MOVEABLE CHRISTMAS TREE STAND

(76) Inventor: Raymond W. Washick, 8221 Fields Ertel Rd., Cincinnati, OH (US) 45249

( * ) Notice: Subject to any disclaimer, the term of this patent is extended or adjusted under 35 U.S.C. 154(b) by 0 days.

(21) Appl. No.: 10/912,992

(22) Filed: Aug. 6, 2004

(65) Prior Publication Data

US 2005/0029426 A1 Feb. 10, 2005

Related U.S. Application Data

(60) Provisional application No. 60/493,925, filed on Aug. 8, 2003.

(51) Int. Cl.
*F16M 13/00* (2006.01)

(52) U.S. Cl. ..... 248/521; 248/349.1

(58) Field of Classification Search ..... 248/349.1, 248/521, 523, 131, 144, 519, 520, 522, 346.06; 384/46, 47

See application file for complete search history.

(56) References Cited

U.S. PATENT DOCUMENTS

| | | | | |
|---|---|---|---|---|
| 2,469,884 A | | 5/1949 | Masone | 248/45 |
| 5,255,886 A | | 10/1993 | Wang | 248/522 |
| D354,930 S | | 1/1995 | Rush et al. | D11/130.1 |
| 5,388,799 A | * | 2/1995 | Keefe | 248/519 |
| 5,492,301 A | * | 2/1996 | Hauser | 248/516 |
| D373,327 S | | 9/1996 | Rush et al. | D11/130.1 |
| 5,743,505 A | | 4/1998 | Sofy | 248/346.01 |
| 5,893,547 A | * | 4/1999 | Cohen, Jr. | 248/521 |
| 6,419,202 B1 | * | 7/2002 | Thurner | 248/525 |
| 6,568,646 B1 | * | 5/2003 | Wess et al. | 248/349.1 |
| 6,572,064 B1 | * | 6/2003 | Letson et al. | 248/349.1 |

OTHER PUBLICATIONS

HMS Mfg. Co., *E.Z. Christmas*. HTTP;//www.hmsmfg.com/products/christmas/christmas.htm, Copyright 2004, Printed Apr. 11, 2005.

Home Stop International, *Tree-Go-Round 995*, HTTP://www.hsionline.com/products/ecbuilders2/itom8383.htm, Printed Apr. 11, 2005.

* cited by examiner

*Primary Examiner*—Ramon O Ramirez
(74) *Attorney, Agent, or Firm*—Wood, Herron & Evans, LLP

(57) ABSTRACT

A rotating movable tree stand comprising a base providing a movable platform, an upper portion rotatably mounted to the base, and at least one mount removably coupled to the upper portion and configured to clamp a tree stand to the upper portion. An upper portion may comprise a plurality of slots in an annual arrangement in which the mounts may be engaged for clamping.

21 Claims, 6 Drawing Sheets

ROTATING MOVEABLE CHRISTMAS TREE STAND

CROSS-REFERENCE TO RELATED APPLICATION

This application claims benefit of previously filed provisional application Ser. No. 60/493,925, filed Aug. 8, 2003, which is hereby incorporated by reference herein in its entirety.

FIELD OF THE INVENTION

This present invention relates generally to a platform for rotating and moving a Christmas tree mounted in a stand and more particularly to easing the process of decorating such a tree.

BACKGROUND OF THE INVENTION

In the observance of the Christmas holiday, evergreen trees, both real and artificial, are often displayed in an upright position using stands and decorated using a variety of lights, ornaments, garland, tinsel, etc. These stands are available in a wide variety of sizes, configurations, and shapes. For example, stands may vary in size based on the height of the tree they are intended to be used with, the base of those stands intended for use with taller trees generally being wider.

Stands may also vary in configuration. For example, stands are commonly available with three, four, or perhaps even five evenly spaced legs, all of which extend radially and somewhat downwardly from the trunk of a tree when in use. Thus, stands with three legs will typically have legs spaced at 120 degree intervals, while stands with four legs will have legs spaced at 90 degree intervals. It follows that stands with five legs will have legs spaced at 72 degree intervals.

Stands may also vary in shape, numerous circular stands having a variety of shapes. For example, a circular stand may have a generally conical shape with an opening or recessed portion at the apex for receiving the trunk of a tree. A circular stand may also be either inwardly or outwardly tapered also having an opening or recess at the apex for receiving the trunk of a tree. Thus, an inwardly tapered circular stand may appear to have an concave taper, while outwardly tapered circular stand may convex taper, appearing somewhat dome shaped. Irrespective of the shape of the upper portion of a particular circular stand, circular stands generally have a circular base upon which they rest.

All of these stands, by virtue of either varying base size, additional legs or circular shape, generally provide some degree of increased stability based on the foregoing. Despite providing varying degrees of stability, none of these stands are particularly adapted for decorating a tree.

For instance, Christmas trees are often placed in the corner of a room or in front of window in a home, allowing persons in the home and/or passers-by to enjoy the tree while generally keeping the tree out of the traffic pattern of one's living space. Such placements, while convenient and advantageous for the enjoyment of such a tree, typically limit accessibility to at least a portion of the tree, making decorating the tree difficult. Thus, one approach to decorating a tree is to decorate the tree while the tree is standing out in the room, and then move the tree into a corner or up to a window.

To anyone who has decorated a tree and then moved it, this approach is obviously fraught with disadvantages. First, in order to decorate a tree with lights, ornaments, garland, tinsel, etc., one needs to travel the periphery and/or circumference of the tree placing decoration along the way. Second, most stands, such as those described herein above, are not particularly adapted for moving a tree, once the tree is placed in the stand. Also, many homes have carpeting or rugs that further complicate moving or sliding such stands, the legs or base catching on the yarn in the carpeting or rugs, the tree falling over in the worst instance, or, perhaps at a minimum, knocking a decoration off the tree breaking it. Further, once the tree is positioned in a corner or in front of a window, it is difficult to move the tree to clean, such as to vacuum or sweep up needles from that fall from real trees.

Several approaches have attempted to addressed these drawbacks all of which fall short in one manner or another.

One approach uses a manual turntable with an adjustable tree trunk mount integrally included in it. Such an approach is clearly not usable with the stands described herein above, nor is the turntable particularly configured for movement of the tree once mounted in the turntable. However, such an approach does apparently allow for the tree mounted in the turntable to be rotated.

Another approach uses a wheeled tree carrier with a mount for adjustably grasping the trunk of a tree. The generally flat surface of the mount includes grooves that provide adjustability for mounting fingers, held in place by wing nuts, and that may be used to hold the tree in an upright position. Such an approach is also not useable with the stands described herein above. However, such an approach does allow for movement and rotation of the tree once mounted in the carrier.

Yet another approach uses a motorized revolving plate with a three legged stand that is held in place by clips riveted to the plate. Such an approach is also not useable with the stands described herein above, nor does the approach allow for movement of the tree once mounted in the stand. However, the approach does allow for rotation of the tree.

Therefore, it is desirable to have a rotating moveable Christmas tree platform capable of use with the a variety of stands.

These objective and other objectives will become more readily apparent from the summary of invention and detailed description of embodiments of the invention set forth herein below.

SUMMARY OF THE INVENTION

The present invention provides a rotating moveable Christmas tree platform capable of use with the a variety of stands. The present invention may also be used to rotate and move other items, such as large house plants.

In one embodiment of the present invention, a rotating movable tree stand comprises a base, providing a movable platform, an upper portion rotatably mounted to the base, and at least one mount removably coupled to the upper portion and configured to clamp a tree stand to the upper portion.

In accordance with a one aspect of the present invention a manually rotatable platform is provided. In accordance with another aspect of the present invention, a motor and drive mechanism may be coupled to the gear on the upper portion of the platform, and used to rotate the platform. In accordance with another aspect of the present invention, an electrical receptacle may added to the upper portion of the platform and an electrical cord may be added to the base.

Wipers and contacts between the upper portion and base provide electrical coupling of the receptacle to the cord. In accordance with yet another aspect of the present invention, a motor and drive mechanism may be coupled to the gear on the upper portion of the platform, and used to rotate the platform and an electrical receptacle may added to the upper portion of the platform and an electrical cord may be added to the base. Wipers and contacts between the upper portion and base provide electrical coupling of the receptacle to the cord.

These features and other features of the invention will be come more readily apparent from the Detailed Description and drawings of the application.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
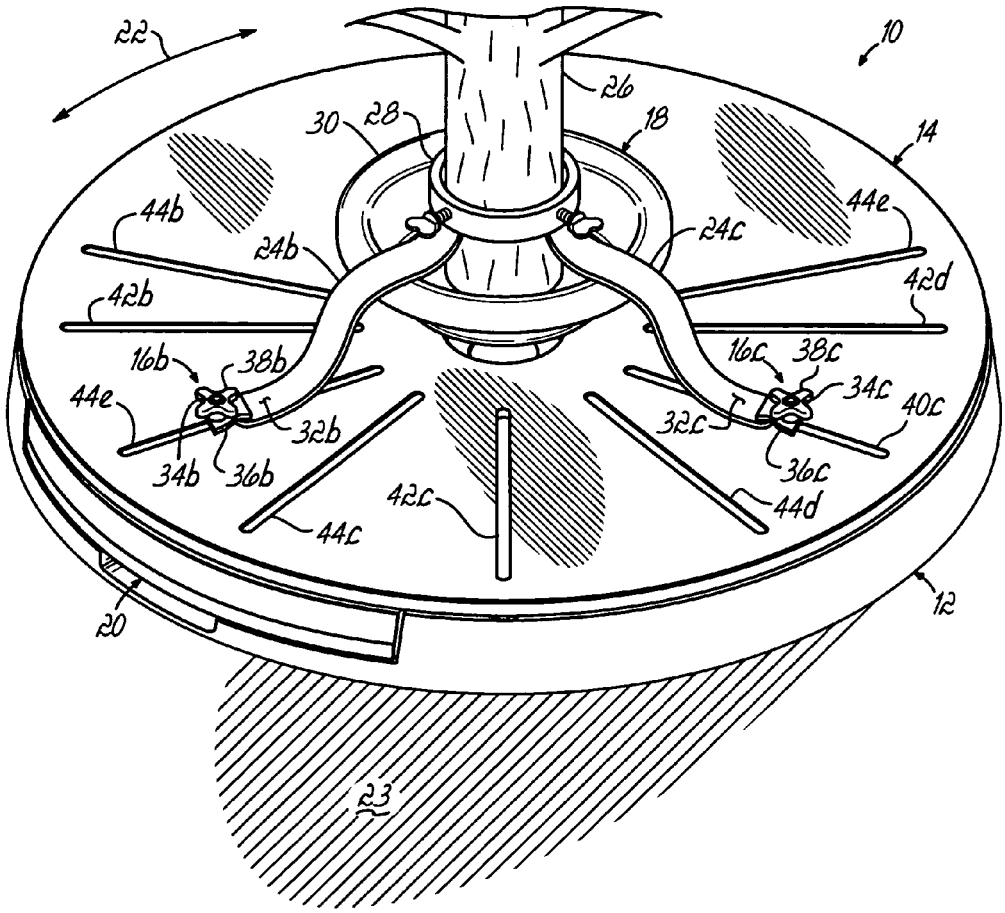
FIG. 1 is a perspective view of one embodiment of the present invention illustrating features thereof.

With reference to FIGS. 1–6, wherein like numerals denote like parts, there is shown one embodiment 10 of a rotating movable tree stand in accordance with the principles of the present invention. Referring first to FIG. 1, a perspective view of rotating movable tree stand 10 is shown. Rotating movable tree stand 10 comprises a base 12 providing a movable platform, an upper portion 14 rotatably mounted to base 12, and at least one mount 16 removably coupled to upper portion 14 and configured to clamp a tree stand 18 to upper portion 14.

A handle 20 coupled to base 12 (shown completely inserted into base 12) selectively enables/disables the rotation of upper portion 14. The rotation, e.g., clockwise and/or counterclockwise, of upper portion 14 is indicated by double arrow 22 when so enabled. For example, when handle 20 is inserted completely into base 12, as shown, upper portion 14 may be prevented from rotating, e.g., disabled. However, when handle 20 is withdrawn from base 12, upper portion 14 may freely rotate as illustrated by double arrow 22.

Moreover, when handle 20 is withdrawn from base 12, handle 20 provides a handhold or means for grasping rotating movable tree stand 10 so that rotating movable tree stand 10 may be slid about on a flat surface, such as floor 23. It will be appreciated that rotating movable tree stand 10 may be slid or moved in any planar direction, e.g., 360 degrees, using handle 20. Additional features of handle 20, and the operation thereof, will be discussed more detail in conjunction with FIGS. 2, 4, and 5.

Still referring to FIG. 1, rotating movable tree stand 10 is configured for use with a variety of Christmas tree stands having differing sizes, configurations and shapes. For example, and as shown in FIG. 1, tree stand 18 comprises three legs 24*a*–*c* (leg 24*a* being hidden from view), a collar 28, and a pan 30. Legs 24*a*–*c* of stand 18 are coupled to collar 28 at an upper most end and pan 30 at an intermediate point. Tree stand 18 receives the trunk of tree 26 through collar 28 located proximate the apex of the stand, while pan 30 supports the bottom of the trunk. Legs 24*a*–*c* extend radially and somewhat downwardly from collar 28, terminating in foot portions 32*a*–*c*, located at the bottom most end of each respective leg 24*a*–*c*, and upon which tree stand 18 rests.

It will be appreciated that when tree stand 18 is used with rotating movable tree stand 10, tree stand 18 may be clamped on rotating movable tree stand 10 and tree 26 placed in tree stand 18. Alternatively, tree 26 may be placed in tree stand 18 and tree stand 18 may be clamped on rotating movable tree stand 10; however, generally, the former is thought to be somewhat easier.

Irrespective of the order of clamping a tree stand to rotating movable tree stand 10 and placing a tree in a tree stand, mounts 16, as illustrated in FIG. 1, are used. More specifically, mounts 16*a*–*c* are configured to engage foot portions 32*a*–*c* located at the bottom most end of each leg 24*a*–*c*, respectively. Mounts 16*a*–*c* each comprise a bolt 34*a*-*c*, a hold down portion or clip 36*a*–*c*, and a thumb knob 38*a*–*c*, respectively.

Generally, mounts 16 number the same as the number of legs in a legged tree stand when used with rotating movable tree stand 10. For example, tree stand 18 has three legs 24*a*–*c* and three mounts 16*a*–*c* are used. However, it will be appreciated that a differing number of mounts 16 may also be used should a user not desire to clamp each and every leg of a particular tree stand. For example, a user may only desire to clamp four legs of a tree stand with five legs. Moreover, it will be appreciated that a number of mounts 16 may be used around the periphery of a circular stand, clamping such a stand to upper portion 14. A number of mounts 16 may also be used to clamp other tree stands having other geometric or irregular shapes to upper portion 14. The use of tree stands with various numbers of legs and/or shapes will be discussed in more detail in conjunction with FIG. 3.

Figure 2:
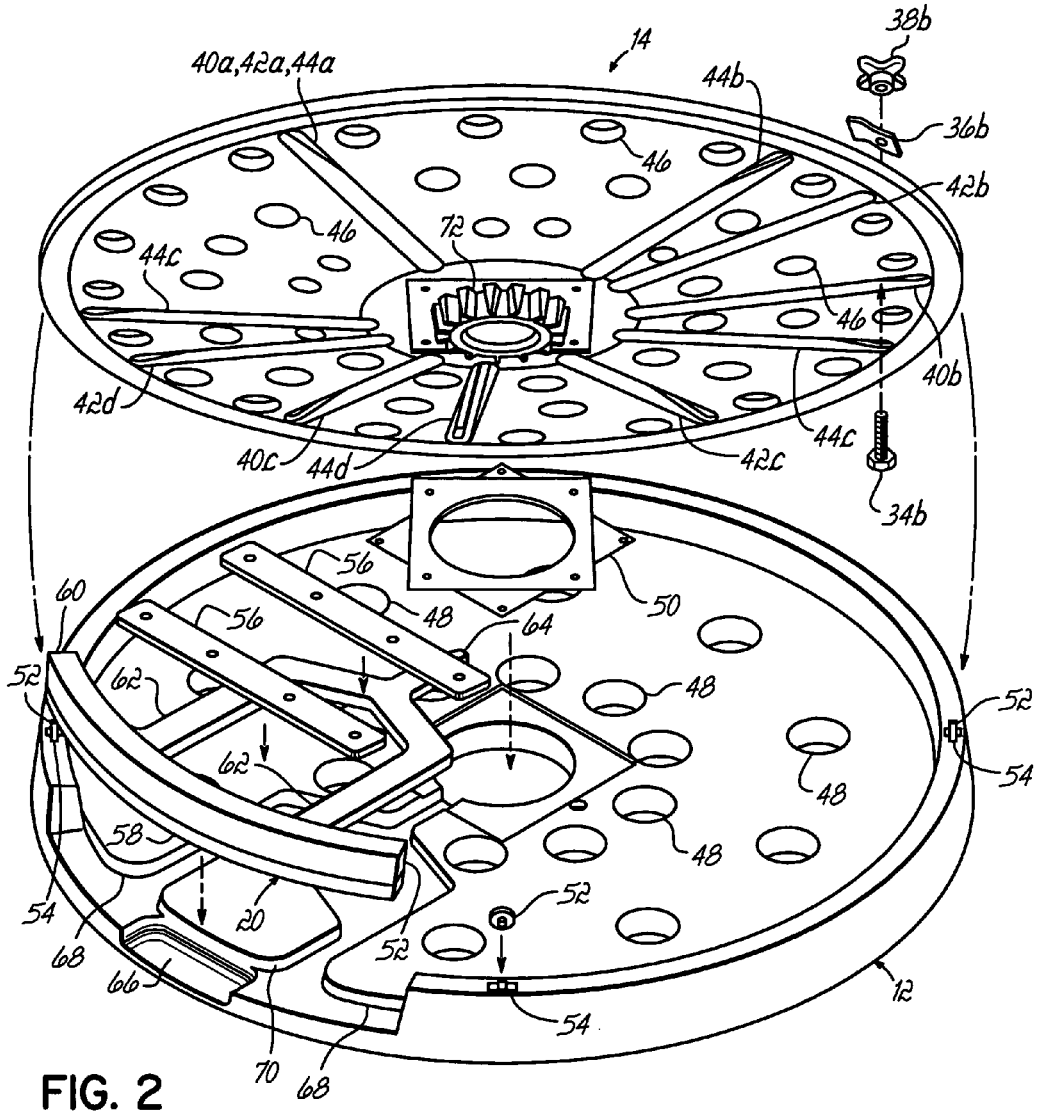
FIG. 2 is disassembly perspective view of the embodiment of FIG. 1.

Referring now to FIGS. 1 and 2 (only bolt 34*b*, clip 36*b*, and thumb knob 38*b* being shown in FIG. 2) bolts 34*a*–*c* are inserted through slots 40*a*–*c*, for example, that correspond to the annular positions of legs 24*a*–*c*. Additional slots 42*a*–*d*, 44*a*–*e* may also be included in upper portion 14 for accommodating other tree stands, such additional slots will also be discussed in more detail in conjunction with FIG. 3.

Bolts 34*a*–*c* are most easily inserted up through slots 40*a*–*c*, through access made available by withdrawing handle 20 from base 12, and rotating upper portion 14, alternately indexing each respective slot 40*a*–*c*. Once inserted in a slot 40*a*–*c*, a clip 36*a*–*c* is placed over a bolt 34*a*–*c* and a thumb knob 38*a*–*c* is threaded onto the bolt 34*a*–*c*. The mounts 16*a*–*c* may then be slid along the respective slots 40*a*–*c* to engage foot portions 32*a*–*c* of legs 24*a*–*c* and thumb knobs 38*a*–*c* tightened down, clamping tree stand 18 to upper portion 14 of rotating movable tree stand 10.

Those skilled in the art will appreciate that mounts 16 may also be used with slots 42*a–d*, 44*a–e*, as desired, should a tree stand having some other size, shape or configuration be used.

Bolts 34*a–c* advantageously included heads that engage portions of slots 40*a–c* and prevent bolts 34*a–c* from turning when thumb knobs 34*a–c* are tightened. Exemplary bolts 34*a–c* include, but not are not necessarily limited to, bolts with oblong, hexagonal or square heads or carriage bolts. Bolts with other head configurations, and capable of preventing rotation when engaged in a slot under tightening Will readily appear to those of skill in the art.

Clips 36*a–c* may be stamped from metal, formed from plastic or be made of some other reasonably rigid material. For example, clips 36*a–c* may be metal supports or pieces commonly used to attach legs to the corner of a table having runners. Such pieces are readily available, and may found in hardware or woodworking stores, or lumber yards.

Thumb knobs 38*a–c* are also commercially available, and may be obtained from numerous fastener vendors known to those of skill in the art. Thumb knobs 38*a–c* may be themselves threaded, as illustrated in FIGS. 1 and 2. Thumb knobs may also include a captive nut, or be configured to receive a nut, such as a hexagonal nut, such thumb knobs having a hexagonal passage for such a nut.

Those of skill in the art will also appreciate that other fasteners may be used in the alternative to thumb knobs. Such other fasteners include, but are not necessarily limited to, nuts, wing nuts, knurled knobs, etc.

Referring now to FIG. 2, base 12 and upper portion 14 are advantageously constructed using rotational molding. The use of rotational molding generally allows the use of a mold that is substantially less costly than molds normally required when using other molding techniques. To this end, numerous projections, columns, indentations, and/or formations 46, 48, respectively, are included in upper portion 14 and base 12. Such formations 46, 48 allow production of large planar surfaces in rotational molding, such as those found in upper portion 14 and base 12, while maintaining a desired tolerance for such surfaces. For example, in one embodiment of the present invention, a rotating movable tree stand may be approximately four feet in diameter. Those skilled in the art will appreciate that other molding techniques, as well as other means of manufacture, may be used to produce upper portion 14 and base 12, and in those instances formations 46, 48 may not be necessary or desirable. Changes in the manner of production of an upper portion and a base do not constitute a departure from the spirit of the present invention.

Upper portion 14 is rotatably mounted or coupled to base 12 using bearing 50. As illustrated, bearing 50 may be one of the captive bearing types including bearings 74 (shown in FIGS. 4 and 5). Such captive bearings are readily available commercially. Those of skill in the art will appreciate that other bearings may be also used without departing from the spirit of the present invention. Bearing 50 reduces the rotation fiction of upper portion 14 when loaded, such as with tree 26, shown in FIG. 1.

Referring still to FIG. 2, base 12 also includes rollers 52 inserted into recesses 54 that also generally reduce the rotational fiction of upper portion 14. More specifically, rollers 52 are configured to reduce side loading of bearing 50, and are particularly useful should the weight of tree 26 in tree stand 18 not be centered when clamped to upper portion 14. However, it will be appreciate that other embodiments of the present invention rollers may not be included.

Also slidably coupled to base 12 is handle 20. For example, handle 20 is coupled to base 12 using straps 56. Straps 56 may be screwed, glued or otherwise attached to base 12 in some other well known manner.

Handle 20 comprises handhold 58, end portions 60, straight portions 62, and tooth 64. Handle 20 may also be advantageously molded of plastic, straight portions 62 extending from handhold 58, and merging into tooth 64, as illustrated. Base 12 comprises recess 66, stops 68, and raised center portion 70.

Recess 66 allows a finger opening for a user to grasp handhold 58 and withdraw handle 20 from base 12 when handle 20 is completely inserted into the base. End portions 68 and/or raised center portion 70 limit the insertion of handle 20 into base 12. Raised portion 70 also limits the withdraw of handle 20 from base 12 by virtue of straight portions 62 merging together into tooth 64.

Coupled to upper portion 14 is gear 72. Gear 72 may also may be molded or machined into upper portion 14 in some embodiments. Tooth 64 of handle 20 is configured to engage gear 72 when handle 20 is inserted in base 12 so as to selectively enable/disable the rotation of upper portion 14. Other methods of slidable coupling handle 20 to base 12 to selective enable/disable the rotation of upper portion 14 will readily appear to those of skill in the art.

Thus, as illustrated in FIGS. 1 and 2, a manually rotatable platform is provided. In other embodiments of the present invention, base 12 may comprise a motor and/or drive mechanism coupled to gear 72, and used to rotate upper portion 14.

In yet other embodiments of the present invention, upper portion 14 comprises an electrical receptacle and base 12 comprises an electrical cord. Wipers and contacts intermittent and coupled to upper portion 14 and base 12 provide electrical coupling of the receptacle and the cord, thereby allowing the receptacle to be energized while upper portion 14 is manually rotated.

In yet still other embodiments of the present invention, base 12 comprises a motor and/or drive mechanism coupled to gear 72 and an electrical cord. Upper portion 14 comprises an electrical receptacle. Wipers and contacts intermittent and coupled to upper portion 14 and base 12 provide electrical coupling of the receptacle and the cord, while a motor or drive mechanism may be used to rotate upper portion 14, thereby allowing the receptacle to be energized while upper portion 14 is rotated by the motor or drive mechanism.

Figure 3:
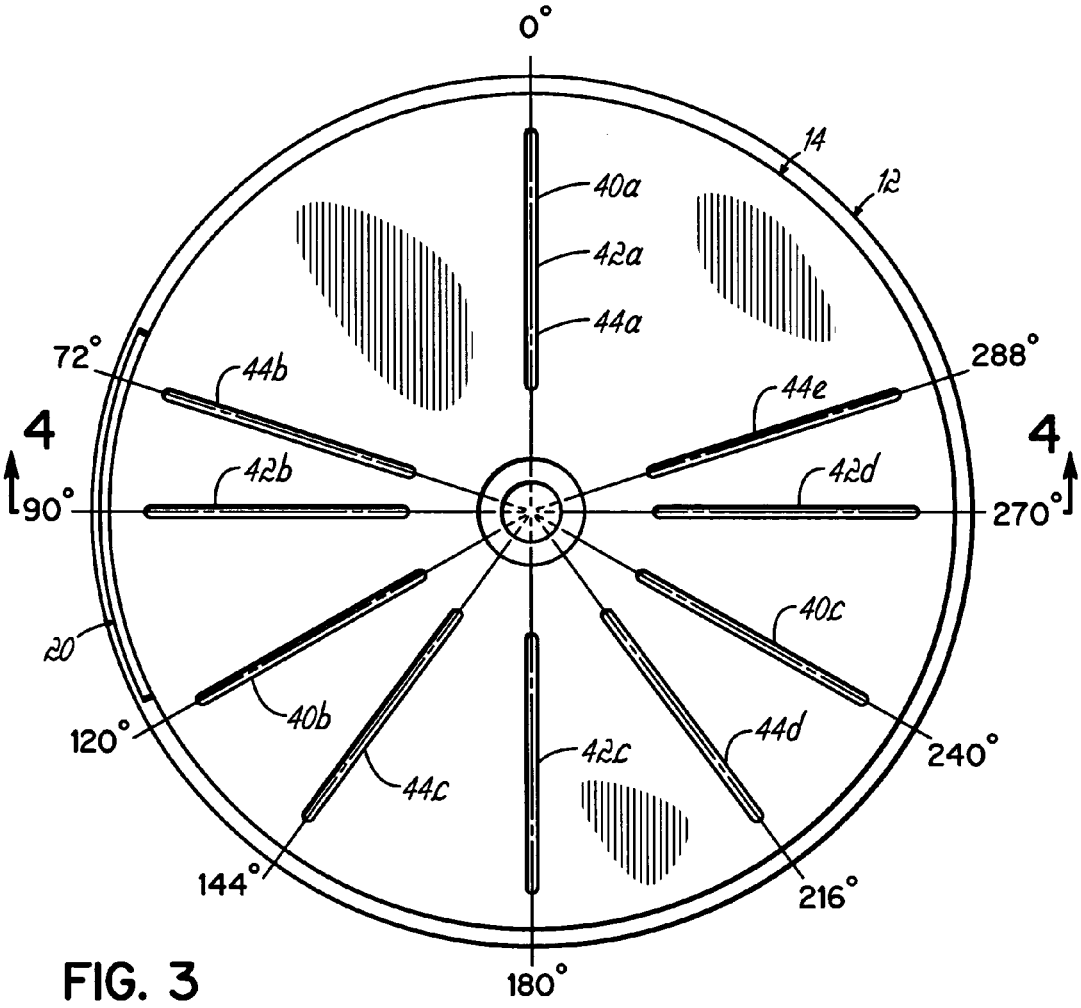
FIG. 3 is a top view of the embodiment shown in FIGS. 1 and 2.

Referring now to FIG. 3, rotating movable tree stand 10 may be used with tree stands having a wide variety of sizes, configurations, and shapes. To this end, upper portion 14 comprises a plurality of slots 40*a–c*, 42*a–d*, 44*a–e*, annularly arranged and generally extending outwardly from the center of upper portion 14 in a radial fashion, each configured to receive a mount 16.

More specifically, slots 40*a–c* are annularly arranged in approximately 120 degree intervals and may be used with tree stands having three legs. For example, as shown in FIG. 3, slots 40*a–c* may be located annularly about upper portion 14 at 0, 120, and 240 degrees, traveling in a counter clockwise fashion. Slots 40*a–c* may be use with tree stand 18 having three legs 24*a–c*, as shown previously in FIG. 1. Slots 40*a–c* may also be used with other three legged stands having differing base dimensions by sliding mounts 16 in slots 40*a–c* to engage the legs of such stands.

In a similar manner, slots 42*a–d* are annularly arranged in approximately 90 degree intervals, and used with tree stands having four legs. For example, slots 42*a–d* may be annularly located at 0, 90, 180, and 240 degrees.

Likewise, slots 44*a–e* may used with tree stands having five legs. Slots 44*a–e* are annularly arranged in approximately 72 degrees intervals. For example, slots 44*a–e* may be annularly located at 72, 144, 216, and 288 degrees.

The annular patterns associated with slots 40*a–c*, 42*a–d*, and 44*a–e* may be arranged so that one of the slots 40*a*, 42*a*, 44*a* is used in each of the patterns, e.g., with three, four and five legged stands. Such an arrangement reduces the number of slots in upper portion 14 and may increase the rigidity of upper portion 14, while simplifying a mold. However, it will be appreciated that such an arrangement may not be necessary, nor desirable, and that other embodiments may include other annular arrangements without departing from the spirit of the present invention.

A tree stand may also be of a circular type having a lower portion or flange capable of being clamped to upper portion 14 using mounts 16. A tree stand may also be of some other type or design having some other geometric or irregular shape, capable of being clamped. A tree stand may also advantageously include holes for affixing the tree stand to upper portion 14, in which instance clips may be required. Irrespective of the type, design or shape of a particular a tree stand, mounts 16 may be inserted in slots 40*a–c*, 42*a–d*, 44*a–e*, as desired by a user, and used to clamp the stand to upper portion 14.

Rotating movable tree stand 10 may also be used without clamping. For example, an alternative use for rotating movable tree stand 10 is as a platform for large house plants. In such use, upper portion 14 may be rotated to allow sunlight to impinge on different side of a plant. Rotating movable tree stand 10 also allows such a large plant to be moved about more easily by sliding rotating movable tree stand 10 by handle 20.

Figure 4:
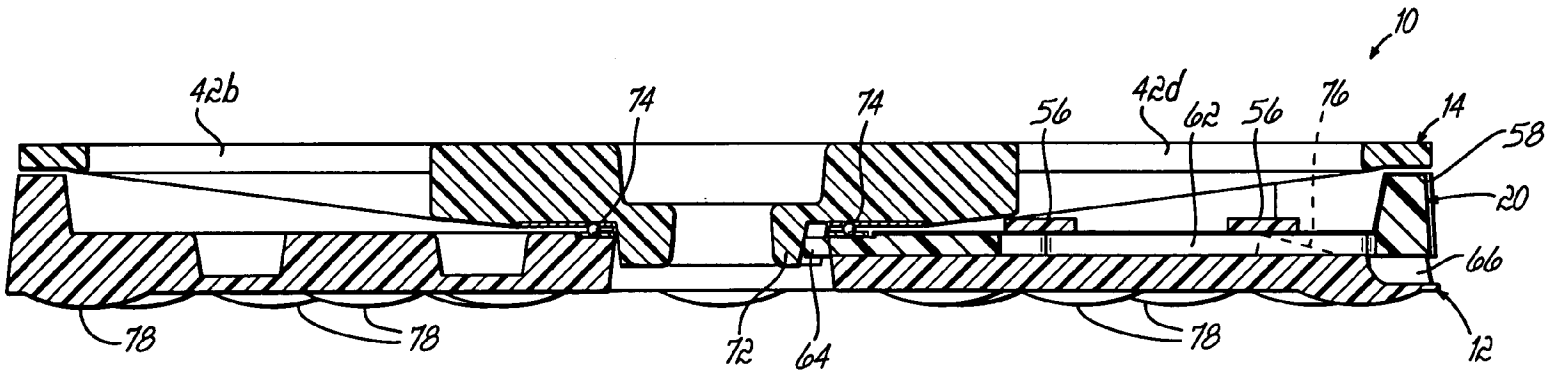
FIG. 4 is a cross sectional view taken along line 4—4 in FIG. 3 with the handle completely inserted into the base.
Figure 5:
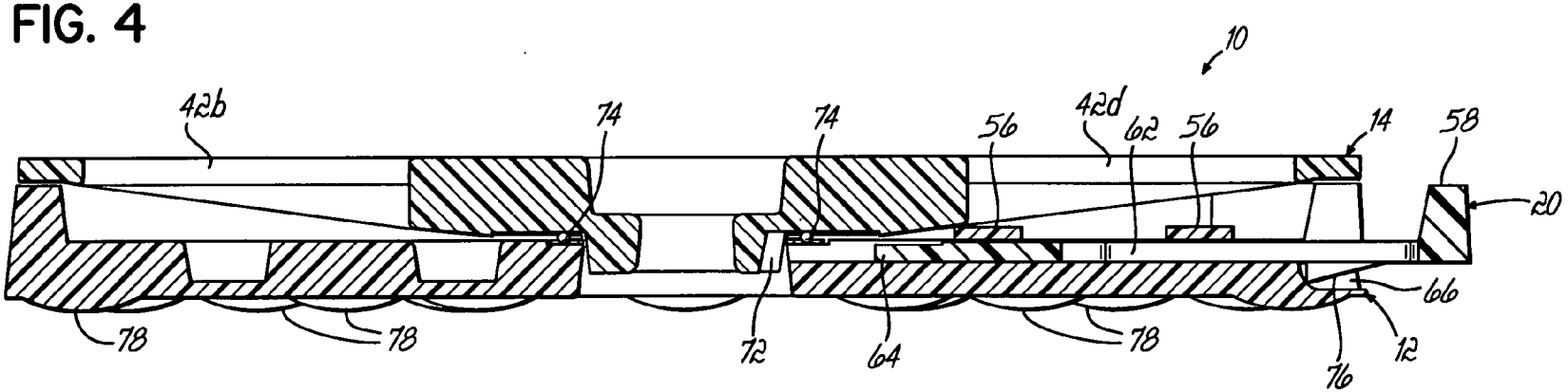
FIG. 5 is a cross sectional view similar to FIG. 4 but with the handle withdrawn from the base.

Referring generally to FIGS. 4 and 5, the operation of handle 20 is shown in more detail. More specifically, FIG. 4 shows a cross sectional view taken along line 4—4 in FIG. 3 with handle 20 completely inserted into base 12, while FIG. 5 shows a cross sectional view similar to FIG. 4 with handle 20 withdrawn from base 20.

Referring to FIG. 4 with handle 20 completely inserted into base 12, tooth 64 engages gear 72 so as to prevent rotation of upper portion 14, e.g, selectively disabling rotation. Moreover, it will be appreciated that tabs 76 (shown in dashed lines) formed as living hinges in the bottoms of straight portions 62, are pressed into straight portions 62.

Referring now to FIG. 5 with handle 20 completely withdrawn from base 12, tooth 64 disengages gear 72 so as to allow rotation of upper portion 14, e.g, selectively enabling rotation. Further, with handle 20 completely withdrawn from base 12, tabs 76 extend from straight portions 62 of handle 20, engaging recess 66 of base 12. When tabs 76 are so engaged in recess 66 of base 12, handle 20 is prevented from being inserted into base 12. Thus, as configured, tabs 76 prevent a user's hand from being pinched between handle 20 and base 12 when grasping handhold 58 and moving rotatable movable tree stand 10.

To reinsert handle 20 into base 12, such as, for example, after rotatable movable tree stand 10 has been moved, a user inserts two fingers into recess 66, depresses tabs 76, and slides handle 20 into base 12.

Figure 6:
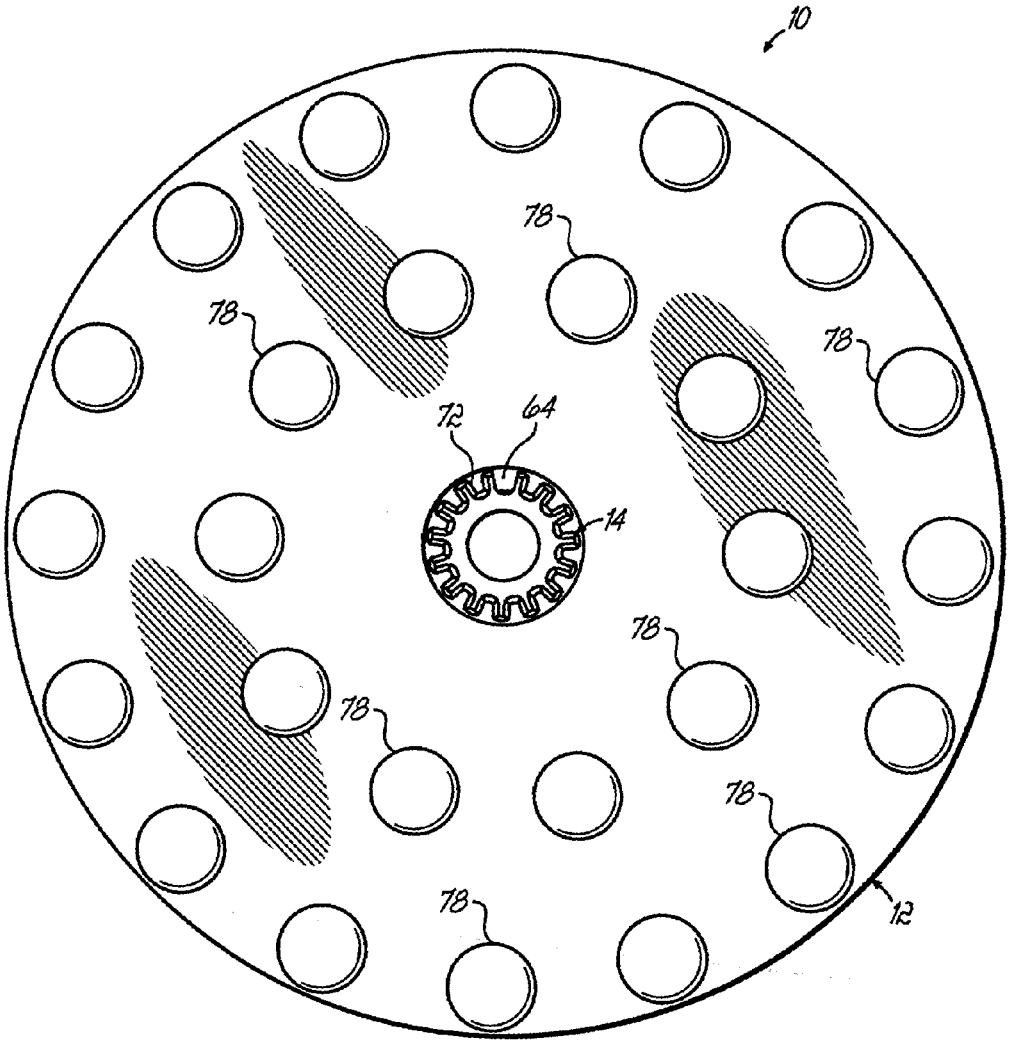
FIG. 6 is a bottom view of the embodiment shown in FIGS. 1–5.

Referring to FIG. 6, a bottom view of the embodiment 10 shown in FIGS. 1–5 is illustrated. As illustrated, base 12 further comprises raised portions or bumps 78 mold into base 12 in the rotational molding process. Raised portions 78 may also be seen in FIGS. 4 and 5. Raised portions 78 are configured to reduce the sliding friction of rotating movable tree stand 10, such as, for example, when used on carpeted floor. It will be appreciated that other embodiments of the present invention may omit such raised portion and that such an omission does not constitute a departure from the spirit of the present invention.

Figure 7:
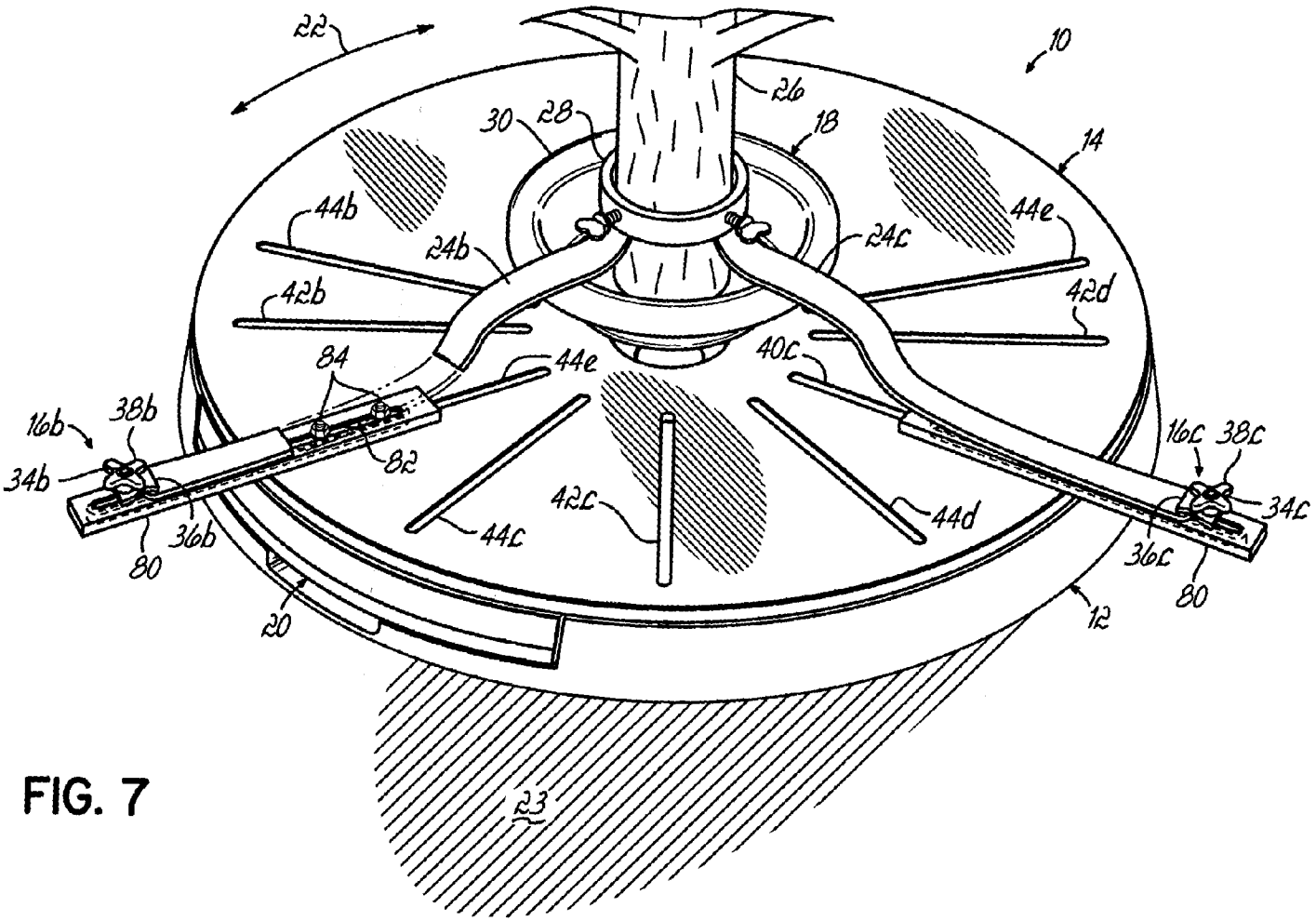
FIG. 7 is a perspective view of extenders used in one embodiment of the present invention with an oversize tree stand.

Referring to FIG. 7, in an embellishment contemplated for the present invention, an extender 80 is utilized to adapt for an oversize tree stand. The extender 80 includes a slot 82 that is compatible in size with slots 42 and 44. Extender 80 is mounted to upper portion 14 using nuts fastened to bolts 84 which pass through the appropriate slot 42 and 44 and slot 82 of extender 80. A mount (two mounts 16*b* and 16*c* shown in FIG. 7), which as before comprises a bolt 34*b*/34*c*, clip 36*b*/36*c* and thumb knob 38*b*/38*c*, is then mounted to slot 82 in extender 80 to mount the legs of an oversize tree stand, as illustrated in FIG. 7.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of representative apparatus and method, and illustrative examples shown and described. Accordingly, departures may be made from such details without departure from the spirit or scope of applicant's general inventive concept.

What is claimed is:

1. A rotating movable tree stand comprising:

a base providing a movable platform;

an upper portion rotatably mounted to the base; and, at least one mount removably coupled to the upper portion and configured to clamp a tree stand to the upper portion wherein the mount may be removably coupled in plural positions relative to the upper portion to permit a range of mounting alternatives.

2. The rotating moveable tree stand of claim 1 wherein the base is rotationally molded.

3. The rotating movable tree stand of claim 2 further comprising a handle slidable coupled to the base, the handle configured to selectively enable/disable the rotation of the upper portion based on insertion of the handle into the base.

4. The rotating movable tree stand of claim 3 wherein the base comprises a recessed portion configured to allow a user to grasp the handle when inserted into the base.

5. The rotating movable tree stand of claim 3 wherein the handle comprises a handhold for grasping when sliding the rotating movable tree stand.

6. The rotating movable tree stand of claim 3 wherein the handle comprises at least one end portion configured to limit the insertion of the handle into the base.

7. The rotating movable tree stand of claim 3 wherein the handle comprises a tooth, and the upper portion comprises a gear, the tooth configured to engage the gear based on insertion of the handle into the base.

8. The rotating movable tree stand of claim 3 wherein the handle comprises tabs configured to prevent insertion of the handle into the base.

9. The rotating moveable tree stand of claim 1 wherein the upper portion is rotationally molded.

10. The rotating movable tree stand of claim 1 wherein the upper portion includes at least one slot and the at least one mount comprises:

a bolt configured for insertion into the slot;

a clip configured to placed over the bolt; and, thumb wheel configured to be threaded onto the bolt wherein the mount engages the tree stand the tightening of the thumb wheel clamps the tree stand to the upper portion.

11. The rotating movable tree stand of claim 1 wherein the upper portion includes a plurality of slots configured to receive the mount.

12. The rotating movable tree stand of claim 1 wherein the upper portion includes a plurality of slots extending from the center of the upper portion outward in a radial fashion.

13. The rotating movable tree stand of claim 1 wherein the upper portion includes three slots annular arranged in approximately 120 degree intervals.

14. The rotating movable tree stand of claim 1 wherein the upper portion includes four slots annular arranged in approximately 90 degree intervals.

15. The rotating movable tree stand of claim 1 wherein the upper portion includes five slots annular arranged in approximately 72 degree intervals.

16. The rotating movable tree stand of claim 1 wherein the upper portion includes a plurality of slots arranged in approximately 120, 90, and 72 degree intervals.

17. The rotating movable tree stand of claim 1 wherein the at least one mount comprises a bolt.

18. The rotating movable tree stand of claim 1 wherein the at least one mount comprises a clip.

19. The rotating movable tree stand of claim 1 wherein the at least one mount comprises a thumb wheel.

20. A rotating movable tree stand comprising:

a base providing a movable platform;

an upper portion rotatably mounted to the base; and, at least one mount removably coupled to the upper portion and configured to clamp a tree stand to the upper portion, wherein the base comprises raised portions on a bottom surface thereof configured to reduce sliding friction.

21. A method of decorating a Christmas tree comprising:

placing a Christmas tree in a stand;

positioning the Christmas tree in the stand on a rotating movable tree stand;

selecting one of a plurality of positions in which the stand may be clamped to the rotating movable tree stand; and clamping the stand to the rotating movable tree stand in the selected position.

* * * * *